US006288481B1

(12) United States Patent
Inkyu et al.

(10) Patent No.: US 6,288,481 B1
(45) Date of Patent: Sep. 11, 2001

(54) IN-LINE ELECTRON GUN FOR CATHODE RAY TUBE HAVING BURRS AND SLITS IN THE SHIELD CUP

(75) Inventors: Park Inkyu; Kim Yoo Seon, both of Kyungki-do (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/169,046

(22) Filed: Oct. 8, 1998

(30) Foreign Application Priority Data

Dec. 17, 1997 (KR) ..... 97-69886

(51) Int. Cl.[7] ..... H01J 29/50

(52) U.S. Cl. ..... 313/413; 313/412; 313/414; 313/421

(58) Field of Search ..... 313/412, 413, 313/414, 448, 440, 409, 446, 421

(56) References Cited

U.S. PATENT DOCUMENTS 4,659,961 * 4/1987 Naiki ..... 313/413
4,877,993 * 10/1989 Ogasa ..... 313/414
5,703,430 * 12/1997 Dekker ..... 313/409
5,736,812 * 4/1998 Park et al. ..... 313/413
6,028,392 * 2/2000 Miyazawa et al. ..... 313/446

* cited by examiner

*Primary Examiner*—Nimeshkumar D. Patel
*Assistant Examiner*—Karrabi Guharay
(74) *Attorney, Agent, or Firm*—Christie, Parker & Hale, LLP

(57) ABSTRACT

An in-line electron gun for a cathode ray tube includes three cathodes arranged in a horizontal line to emit thermal electrons. A plurality of grid electrodes are sequentially placed along a common axis from the cathodes to focus and accelerate the thermal electrons into beam shapes. Each of the grid electrodes has three beam-guide holes for producing three primary colors of red, green and blue. A shield cup is attached to the outermost grid electrode. The shield cup includes a bottom side having red, green and blue beam-guide holes arranged in a row, and a side wall drawn from the circumference of the bottom side with a cylindrical shape. The shield cup includes an induced electromotive force increasing unit for increasing the electromotive force operating in the vicinity of the red and blue beam-guide holes, and an induced electromotive force decreasing unit for decreasing the electromotive force operating in the vicinity of the green beam-guide hole.

17 Claims, 4 Drawing Sheets

IN-LINE ELECTRON GUN FOR CATHODE RAY TUBE HAVING BURRS AND SLITS IN THE SHIELD CUP

CROSS REFERENCE TO RELATED APPLICATION

This application is based on application No. 97-69886 filed in Korean Industrial Property Office on Dec. 17, 1997, the content of which is incorporated hereinto by reference.

FIELD OF THE INVENTION

The present invention relates to an in-line electron gun for a cathode ray tube (CRT) and, more particularly, to an in-line electron gun suitable for a high-resolution CRT.

BACKGROUND OF THE INVENTION

Generally, CRTs are provided with an in-line electron gun where three cathodes are arranged in a horizontal line to emit thermal electrons. The thermal electrons emitted from the cathodes pass through a plurality of grid electrodes and a shield cup while being focused and accelerated to form three electron beams for exciting three different phosphors that produce the three primary colors of red (R), green (G), and blue (B).

In order to excite the correct phosphors, the electron beam should be converged on one point of the screen. For this purpose, the electron beam is deflected by a deflection yoke placed around the outer periphery of the funnel and passes through a beam-guide aperture of the color-selecting shadow mask. This convergence state becomes a critical factor for the resolution of the CRT.

It is known that the resolution of the CRT can be improved through increasing screen image constituting signals by enhancing a horizontal deflection frequency of the deflection yoke. However, with this method, the electron beam is liable to be diverged on the screen. This divergence can be explained on the basis of Lenz's law.

According to Lenz's law, when a changing magnetic field crosses a conductor, an induced electromotive force is produced across the conductor in such a direction as to oppose the change that produces it.

In this connection, the shield cup formed with conductive materials acts as the conductor. When the deflection yoke generates a strong magnetic field with the enhanced horizontal deflection frequency, the magnetic field heavily influences the shield cup. The magnetic fields are initially directed from left to right because the horizontally deflected electron beam is scanning the screen in that direction. The direction of the magnetic field is then abruptly changed from right to left to perform the scanning from the left side of the screen and, hence, an induced electromotive force is produced across the shield cup in a direction opposite to the change of the magnetic field.

Such an induced electromotive force is formed intensely in the vicinity of the G beam-guide hole of the shield cup due to the structure of the CRT. With the induced electromotive force, as shown in FIG. 6, the G beam should be deflected toward the left side S1 of the screen with a smaller size than the R and B beams. On the contrary, the G beam is deflected toward the right side S2 with a larger size than the R and B beams. This divergence, called "a horizontal center raster (HCR) phenomenon", causes the resolution at the peripheral portion of the screen to seriously deteriorate.

SUMMARY OF THE INVENTION

It is an object of the present invention to provide an electron gun for a CRT for preventing divergence of the electron beam at the peripheral portion of the screen while maintaining the horizontal deflection frequency of the deflection yoke at a high degree.

In order to achieve this object and others, the CRT electron gun includes three cathodes arranged in a horizontal line to emit thermal electrons. A plurality of grid electrodes are sequentially placed along a common axis from the cathodes to focus and accelerate the thermal electrons into beam shapes. Each of the grid electrodes has three beam-guide holes for producing three primary colors of red, green and blue. A shield cup is attached to the outermost grid electrode. The shield cup includes a bottom side having red, green and blue beam-guide holes arranged in a row, and a side wall drawn from the circumference of the bottom side with a cylindrical shape. The shield cup includes an induced electromotive force increasing unit for increasing the electromotive force operating in the vicinity of the red and blue beam-guide holes, and an induced electromotive force decreasing unit for decreasing the electromotive force operating in the vicinity of the green beam-guide hole.

The induced electromotive force increasing unit is formed with burrs formed along the circumferences of the red and blue beam-guide holes of the shield cup each with a predetermined diameter and a predetermined height. The induced electromotive force decreasing unit is formed with slits opposite to each other and centered around the green beam-guide hole, formed along the side wall of the shield cup with a predetermined width and a predetermined depth.

BRIEF DESCRIPTION OF THE DRAWINGS

A more complete appreciation of the invention, and many of the attendant advantages thereof, will be readily apparent as the invention becomes better understood by reference to the following detailed description when considered in conjunction with the accompanying drawings, wherein.

DETAILED DESCRIPTION OF THE PREFERRED EMBODIMENTS

Reference will now be made in detail to the preferred embodiments of the present invention, examples of which are illustrated in the accompanying drawings.

Figure 1:
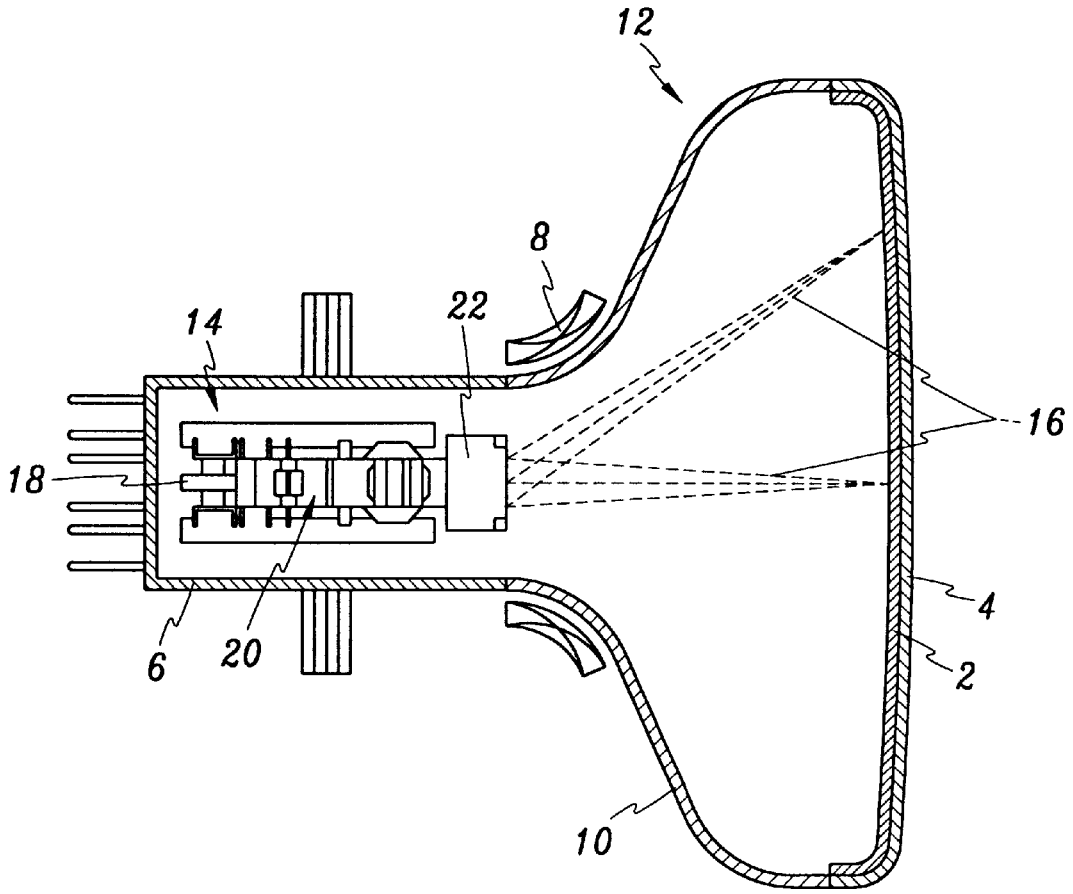
FIG. 1 is a schematic sectional view of a CRT with an electron gun according to a preferred embodiment of the present invention.

FIG. 1 is a schematic sectional view of a CRT with an electron gun according to a preferred embodiment of the present invention. As shown in FIG. 1, the CRT includes a faceplate panel 4 having an inner phosphor screen 2, a funnel 10 sealed to the rear of the panel 4, a neck 6 connected to the rear of the funnel 10 and provided with an internal in-line electron gun 14, and a deflection yoke 8 mounted around the funnel 10 to scan electron beams 16 emitted from the electron gun 14 across the phosphor screen 2.

The electron gun 14 includes three cathodes 18, a plurality of grid electrodes 20 sequentially placed along a common axis from the cathodes 18, and a shield cup 22 attached to the outermost grid electrode 20.

In operation, the electron beams 16 emitted from the electron gun 14 are scanning on the phosphor screen 2 under the influence of horizontal and vertical magnetic fields of the deflection yoke 8.

The electron gun 14 is the in-line type where three cathodes are arranged in a horizontal line. Each of the grid electrodes 20 and the shield cup 22 have three beam-guide holes corresponding to the three cathodes.

Figure 2:
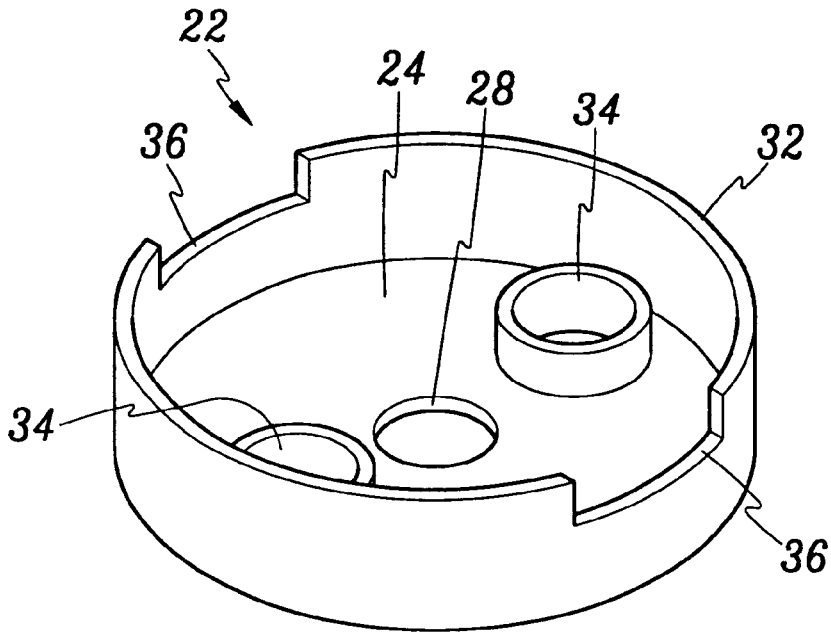
FIG. 2 is a perspective view of the shield cup of the electron gun shown in FIG. 1.
Figure 3:
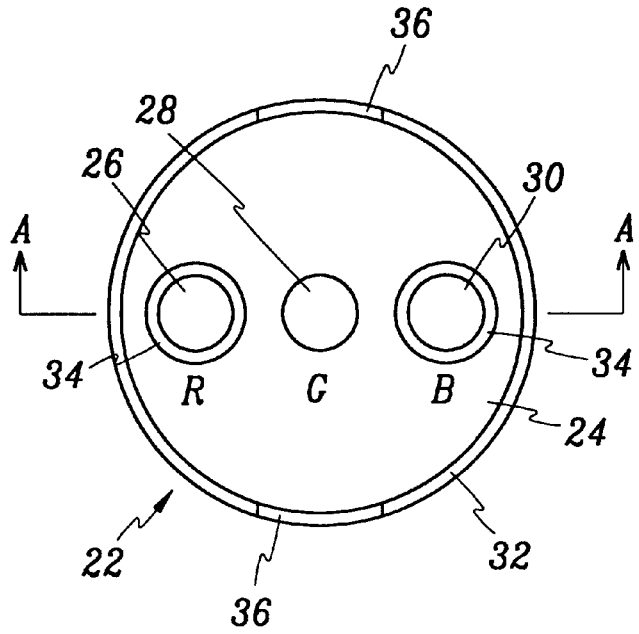
FIG. 3 is a plan view of the shield cup of the electron gun shown in FIG. 1.
Figure 4:
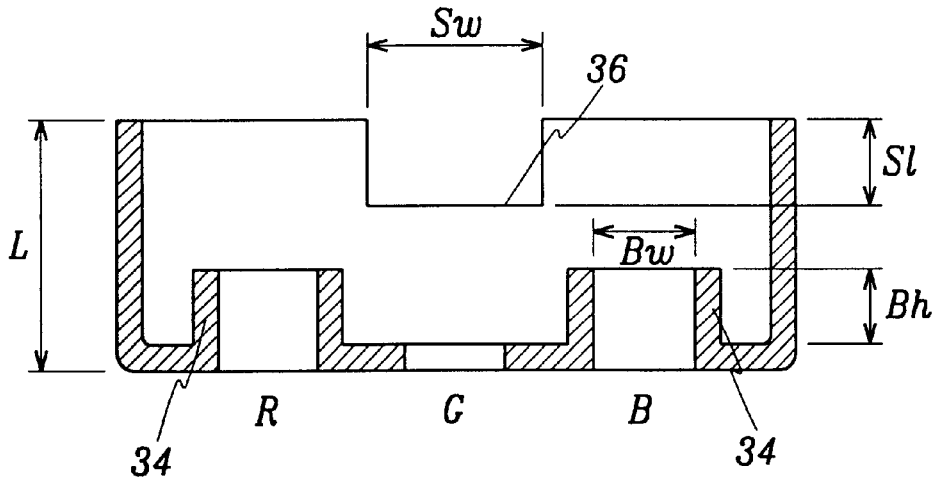
FIG. 4 is a cross sectional view taken along A—A line of FIG. 3.

FIG. 2 to 4 show a shield cup according to a preferred embodiment of the present invention, respectively. As shown in the drawings, the shield cup 22 has a bottom side 24 having an R beam-guide hole 26, a G beam-guide hole 28 and a B beam-guide hole 30 arranged in a row, and a side wall 32 drawn from the circumference of the bottom side 24 with a cylindrical shape.

The shield cup 22 is structured to prevent divergence of the electron beams 16 by controlling the induced electromotive power applied thereto due to the strong horizontal deflection magnetic field of the deflection yoke 8. That is, when the induced electromotive power is produced across the shield cup 22, the R and B electron beams are controlled to pass the corresponding beam-guide holes 26 and 30 of the shield cup 22 under the influence of relatively higher electromotive power. On the contrary, the G electron beam is controlled to pass the corresponding beam-guide hole 28 of the shield cup 22 under the influence of relatively lower electromotive power.

For this purpose, the shield cup 22 includes an induced electromotive force increasing unit for increasing the electromotive force operating in the vicinity of the R and B beam-guide holes 26 and 30 of the shield cup 22, and an induced electromotive force decreasing unit for decreasing the electromotive force operating in the vicinity of the G beam-guide hole of the shield cup 22.

The electromotive force increasing unit is formed with burrs 34 formed along the circumferences of the R and B beam-guide holes 26 and 30. As shown in FIG. 4, each of the burrs 34 has a predetermined diameter Bw and a predetermined height Bh. The burr 34 has a hollow cylindrical shape preferably projected upward from the bottom side 24 of the shield cup 22.

The diameter Bw of the burr 34 is identical with that of the R or B beam-guide hole 26 or 30 which is in the range of 3.0~4.4 mm. The height Bh of the burr 34 is smaller than the radius of the R or B beam-guide hole 26 or 30.

The electromotive force decreasing unit is formed with slits 36 centered around the G beam-guide hole 28 of the shield cup 22 opposite to each other. Each slit 36 is formed along the side wall 32 of the shield cup 22 in the vicinity of the G beam-guide hole 28.

The slit 36 has a width Sw smaller than the height L of the side wall 32 and larger than its own depth S1. The ratio of the width Sw to the depth S1 of the slit 36 is preferably 4:3.

The number and dimensions of the burrs 34 and slits 36 are not limited to the aforementioned values and can be varied in accordance with the manufacturing conditions of the CRT.

For example, the dimensions of the burrs 34 and slits 36 were established with predetermined values and their horizontal center raster (HCR) characteristics were tested. In this test, the horizontal deflection frequency of the deflection yoke 8 was predetermined in the range of 31.5~84 kHz. The results are given in Table 1.

TABLE 1

| | Dimension of Burr and Slit (mm) | Change in HCR (mm) |
|---|---|---|
| Test 1 | Bh = 2.0, Sw = 10, S1 = 6 | 0.06 |
| Test 2 | Bh = 2.0, Sw = 10, S1 = 4 | 0.08 |
| Prior Art | No Burr and Slit | 0.20 |

As known from Table 1, with the burrs 34 and slits 36, the inventive shield cup 22 yields a convergence characteristic much better than the conventional shield cup.

Figure 5:
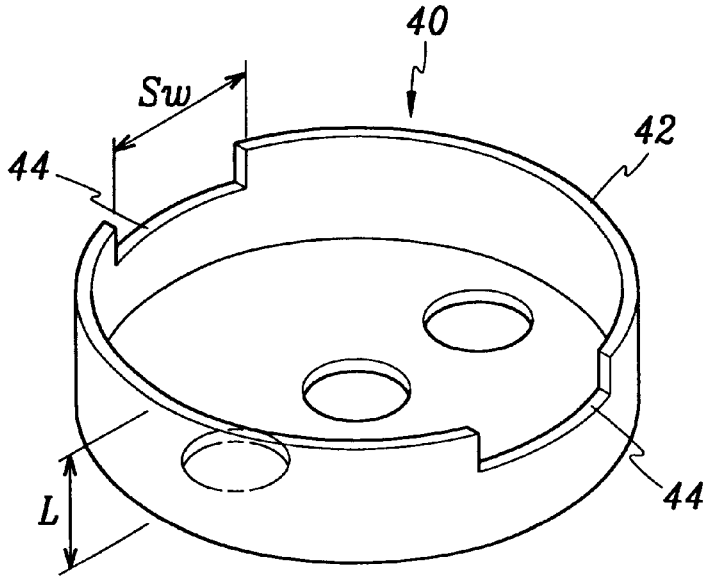
FIG. 5 is a perspective view of a shield cup of a CRT electron gun according to a second preferred embodiment of the present invention.
Figure 6:
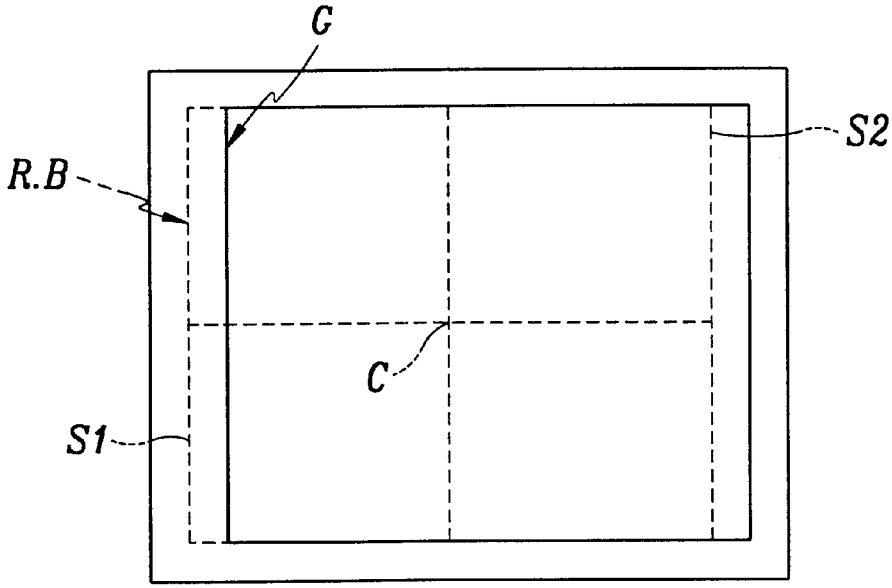
FIG. 6 is a schematic diagram illustrating convergence characteristics of electron beams deflected on a CRT screen according to a prior art.

A second preferred embodiment of the present invention will be now described with reference to FIG. 5. As shown in FIG. 5, a shield cup 40 has only slits 44 formed along the side wall 42 without any burr. The slit 44 preferably has a width Sw satisfying the following condition.

$$L>1.01\times Sw$$

where L is the height of the shield cup 40.

Furthermore, the slit 44 preferably has a depth S1 satisfying the following condition.

$$Sl>0.42\times L$$

where L is the height of the shield cup 40.

For example, the dimensions of the slit 44 were established with predetermined values and their horizontal center raster (HCR) characteristics were tested. In this test, the horizontal deflection frequency of the deflection yoke was predetermined in the range of 31.5~84 khz. The results are given in Table 2.

TABLE 2

| | Dimension of Slit (mm) | Change in HCR (mm) |
|---|---|---|
| Test 1 | Sw = 10, S1 = 6 | 0.08 |
| Test 2 | Sw = 10, S1 = 4 | O.12 |
| Prior Art | No Slit | 0.20 |

As known from Table 2, with the slits 44, the inventive shield cup 40 yields a convergence characteristic better than the conventional shield cup.

As described above, with the inventive shield cup, divergence of the electron beams is largely prevented by controlling the induced electromotive power produced across the shield cup due to the strong horizontal deflection magnetic field of the deflection yoke, resulting in enhanced resolution.

It will be apparent to those skilled in the art that various modifications and variations can be made in the in-line electron gun for a CRT of the present invention without departing from the spirit or scope of the invention. Thus, it is intended that the present invention covers modifications and variations of this invention provided they come within the scope of the appended claims and their equivalents.

What is claimed is:

1. An in-line electron gun for a cathode ray tube, comprising:

three cathodes arranged in a horizontal line to emit thermal electrons;

a plurality of grid electrodes sequentially placed along a common axis transversing the horizontal line to focus and accelerate the thermal electrons into beam shapes, each of the grid electrodes having red, green and blue beam-guide holes, said grid electrodes comprising an outermost grid electrode spaced away from the three cathodes along the common axis; and a shield cup attached to the outermost grid electrode, the shield cup including a bottom having red, green and blue beam-guide holes having predetermined diameters and arranged in a row, and a side wall extending from a circumference of the bottom and having a substantially cylindrical shape, the shield cup comprising an induced electromotive force increasing unit for increasing the electromotive force near the red and blue beam-guide holes, and an induced electromotive force decreasing unit for decreasing the electromotive force near the green beam-guide hole, wherein the electromotive force increasing unit comprises a first burr formed along a circumference of the red beam-guide hole of the shield cup and a second burr formed along a circumference of the blue beam-guide hole of the shield cup, each of the burrs having a predetermined diameter and a predetermined height; and wherein the electromotive force decreasing unit comprises two opposing slits formed in the side wall and centered around the green beam-guide hole of the shield cup, each of the slits having a width less than or equal to the distance between the red and blue beam-guide holes and a predetermined depth.

2. The in-line electron gun of claim 1 wherein one of the burrs extends upward from the bottom of the shield cup.

3. The in-line electron gun of claim 2 wherein the diameter of one of the burrs is identical with a diameter of its respective beam-guide hole of the shield cup.

4. The in-line electron gun of claim 2 wherein the height of one of the burrs is smaller than a radius of its respective beam-guide hole of the shield cup.

5. The in-line electron gun of claim 1 wherein the diameter of one of the burrs is substantially identical with a diameter of its respective beam-guide hole of the shield cup.

6. The in-line electron gun of claim 1 wherein the height of one of the burrs is smaller than a radius of its respective beam-guide hole of the shield cup.

7. The in-line electron gun of claim 1 wherein the width of one of the slits is smaller than a height of the side wall of the shield cup and larger than the depth of its respective slit.

8. An in-line electron gun for a cathode ray tube, comprising:

three cathodes arranged in a horizontal line to emit thermal electrons;

a plurality of grid electrodes sequentially placed along a common axis transversing the horizontal line to focus and accelerate the thermal electrons into beam shapes, each of the grid electrodes having red, green and blue beam-guide holes, said grid electrodes comprising an outermost grid electrode spaced away from the three cathodes along the common axis; and a shield cup attached to the outermost grid electrode, the shield cup including a bottom having red, green and blue-beam guide holes having predetermined diameters and arranged in a row, and a side wall extending from a circumference of the bottom and having a substantially cylindrical shape, the shield cup comprising an induced electromotive force decreasing unit for decreasing the electromotive force near the green beam-guide hole, wherein the induced electromotive force decreasing unit comprises two opposing slits formed in the side wall and centered around the green beam-guide hole of the shield cup, each of the slits having a width less than or equal to the distance between the red and blue beam-guide holes and a predetermined depth.

9. The in-line electron gun of claim 8 wherein the width Sw of one of the slits satisfies the following condition:

$$L \geqq 1.01 \times Sw$$

where L is a height of the side wall.

10. The in-line electron gun of claim 9 wherein the depth S1 of the slit satisfies the following condition:

$$S1 \geqq 0.42 \times L$$

where L is the height of the side wall.

11. The in-line electron of claim 8 wherein the depth S1 of the one of the slits satisfies the following condition:

$$S1 \geqq 0.42 \times L$$

where L is a height of the side wall.

12. A cathode ray tube, comprising:

a panel having a phosphor screen;

a funnel sealed to the panel; and a neck connected to the funnel, said neck having an in-line electron gun comprising, three cathodes arranged in a horizontal line to emit thermal electrons, a plurality of grid electrodes sequentially placed along a common axis transversing the horizontal line to focus and accelerate the thermal electrons into beam shapes, each of the grid electrodes having red, green and blue beam-guide holes, said grid electrodes comprising an outermost grid electrode spaced away from the three cathodes along the common axis, and a shield cup attached to the outermost grid electrode, the shield cup including a bottom having red, green and blue-beam guide holes having predetermined diameters and arranged in a row, and a side wall extending from a circumference of the bottom and having a substantially cylindrical shape, the shield cup comprising an induced electromotive force decreasing unit for decreasing the electromotive force near the green beam-guide hole, wherein the induced electromotive force decreasing unit comprises two opposing slits formed in the side wall and centered around the green-beam-guide hole of the shield cup, each of the slits having a width which is less than or equal to the distance between the red and blue beam-guide holes and a predetermined depth.

13. The cathode ray tube of claim 12 wherein the shield cup further comprises an induced electromotive force increasing unit for increasing the electromotive force near the red and blue beam-guide holes, the induced electromotive force increasing unit comprising a first burr formed along a circumference of the red beam-guide hole of the shield cup and a second burr formed along a circumference of the blue beam-guide hole of the shield cup, each of the burrs having a predetermined diameter and a predetermined height.

14. The cathode ray tube of claim 13 wherein one of the burrs extend upward from the bottom of the shield cup.

15. The cathode ray tube of claim 13 wherein the diameter of one of the burrs is substantially identical with a diameter of its respective beam-guide hole of the shield cup.

16. The cathode ray tube of claim 13 wherein the height of one of the burrs is smaller than a radius of its respective beam-guide hole of the shield cup.

17. The cathode ray tube of claim 12 wherein the width of one of the slits is smaller than a height of the side wall of the shield cup and larger than the depth of its respective slit.

* * * * *